US008591325B2

(12) United States Patent
Delaney et al.

(10) Patent No.: US 8,591,325 B2
(45) **Date of Patent: *Nov. 26, 2013**

(54) FIXED POOL BONUS METHOD AND APPARATUS

(75) Inventors: Michael Delaney, Reno, NV (US); Loren Travis Nelson, Reno, NV (US); Warren White, Reno, NV (US); Robert A. Luciano, Jr., Reno, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 334 days.

This patent is subject to a terminal disclaimer.

(21) Appl. No.: 13/161,752

(22) Filed: Jun. 16, 2011

(65) Prior Publication Data

US 2012/0157188 A1 Jun. 21, 2012

Related U.S. Application Data

(63) Continuation of application No. 10/645,153, filed on Aug. 21, 2003, now Pat. No. 7,967,675.

(60) Provisional application No. 60/405,120, filed on Aug. 22, 2002.

(51) Int. Cl.
*G07F 17/32* (2006.01)

(52) U.S. Cl.
USPC ..... 463/29; 463/16; 463/20; 463/25

(58) Field of Classification Search
USPC ..... 463/16, 20, 25, 29
See application file for complete search history.

(56) References Cited

U.S. PATENT DOCUMENTS 7,967,675 B1 * 6/2011 Delaney et al. ..... 463/20

* cited by examiner

*Primary Examiner* — Omkar Deodhar
(74) *Attorney, Agent, or Firm* — Marvin Hein

(57) ABSTRACT

A gaming system that uses centrally determined game outcomes to generate both a simulated primary game and a multiplicity of bonus games are revealed. The predetermined outcome bonus games are designed to mimic actual Nevada-style bonus games using novel methods to both create the look-and-feel of the actual bonus games as well as being able to use existing central determination game system protocols, which have severe limitations in their message fields.

8 Claims, 4 Drawing Sheets

Player Terminal

Gaming Style Machine
Player Terminal

Central Determination System With Player Terminals And Central Server

Fixed-Pool Bonus Process

FIXED POOL BONUS METHOD AND APPARATUS

This application is a continuation of U.S. patent application Ser. No. 10/645,153 entitled "FIXED POOL BONUS METHOD AND APPARATUS," filed on Aug. 21, 2003, which claims the benefit of provisional application 60/405,120, filed on Aug. 22, 2002.

All of the above referenced applications are hereby incorporated by reference in their entireties for all purposes.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

1. Field of the Invention

This invention pertains generally to games of chance using fixed pools from which winnings are drawn. More particularly, the invention is a method and apparatus for enabling bonus plays on gaming machines where winnings are drawn from fixed pools.

2. Description of the Related Art

Traditional fixed pool games are those where a set of draws, prizes, and prize amounts are predetermined. The entire set of draws (including draws having no winnings) is called a fixed or known pool. To play, players draw individual results from the pool. "Drawing" from the pool is traditionally achieved by printing a set of tickets such that one ticket represents one draw from the pool; these tickets are called pre-printed tickets, where the winnings/losings are printed inside each ticket (or under black ink which is scraped off, in which case they are called "scratchers"). A player participates in the draw by purchasing individual pre-printed tickets.

With the advent of Amerindian casinos being run under IGRA (25 U.S.C. §2701-2721), the interest in Class II games has risen dramatically. Class II games can be used in Amerindian casinos without entering into state compacts, a significant advantage over Class III (Nevada-style) games. Traditional fixed pool games such as scratch tickets are categorized as Class II games. As a result, games based on fixed pools that provide more player interest and excitement than traditional scratch tickets or lottery tickets are in demand.

There has been some success in the manufacture of games making use of fixed pools in Amerindian casinos. When a player plays a game in an Amerindian casino, the game makes a request for a game result from a central server. The central server holds the fixed pools, and when a request comes in from a gaming machine, the server randomly picking one result from the pool (the electronic equivalent of a player buying a ticket).

The draw results are sent to the game machine, which displays the pre-determined result to the player in an entertaining fashion. A typical display will in some fashion mimic a video slot reel machine, showing reels spinning and stopping in such a way that the "wins" on the reel symbols match the amount of the pre-determined win. However, the games are extremely limited in terms of play options because of the limitations of using fixed, pre-determined results. For example, there can be no traditional Nevada-style bonus games, because they ordinarily involve winnings based on randomized events beyond that of the initial winnings. Thus, traditional gaming solutions for added secondary games, bonus games, progressives, etc., cannot be used with fixed pool gaming machines. The result has been fixed pool games that provide no added play and very little entertainment beyond simply displaying a result from the fixed pool.

Because of the above-described limitations, there is a need find a way to provide players of fixed pool gaming machines with features found in Nevada-style gaming, especially game bonus rounds or bonuses.

SUMMARY OF THE INVENTION

In accordance with one or more embodiments of the invention, a gaming terminal includes a player terminal in operable communication with a central server and configured to send game play requests to the central server and receive game play results from the central server. The game play results are determined by the central server from fixed-pools of elements derived from a non-fixed-pool slot machine game, where each element corresponding to a single game play result determined prior to base and bonus game play. The player terminal is further configured to determine a base game play result and a bonus game play result from a single game play result received from the central server and to reverse-map the base game play result into a display such that the display simulates the non-fixed-pool slot machine game by showing game indicia having an award value corresponding to the base game play result. The player terminal further simulates the non-fixed-pool slot machine game by showing a bonus game display, different from the base game play display, that has a value corresponding to the bonus game play result and wherein the single game play result is a fixed sum that is awarded to the player.

In accordance with other embodiments of the invention, a method of providing game play at a gaming terminal includes steps of receiving a wager on a game at the player terminal, generating a game result request at the player terminal, and receiving a game result selected from a fixed pool of game results derived from a non-fixed-pool slot machine game at the player terminal, wherein the game play result represents a fixed sum award determined prior to base and bonus game play. The method further includes the steps of determining a base game result and a bonus game amount from the selected game result; and simulating the non-fixed pool slot machine game by: playing the game and awarding the base game result; starting a bonus game; enabling play of the bonus game; and awarding the bonus game amount.

Other features and advantages will become apparent from the following detailed description, taken in conjunction with the accompanying drawings, which illustrate by way of example, the features of the various embodiments.

BRIEF DESCRIPTION OF THE DRAWINGS

The present invention will be more fully understood by reference to the following drawings, which are for illustrative purposes.

DETAILED DESCRIPTION OF THE INVENTION

Persons of ordinary skill in the art will realize that the following description of the present invention is illustrative, not limiting. Other embodiments and variations in the structure and method of the invention will suggest themselves to such skilled persons who have the benefit of the present disclosure, all within the inventive nature of the present disclosure.

Figure 1:
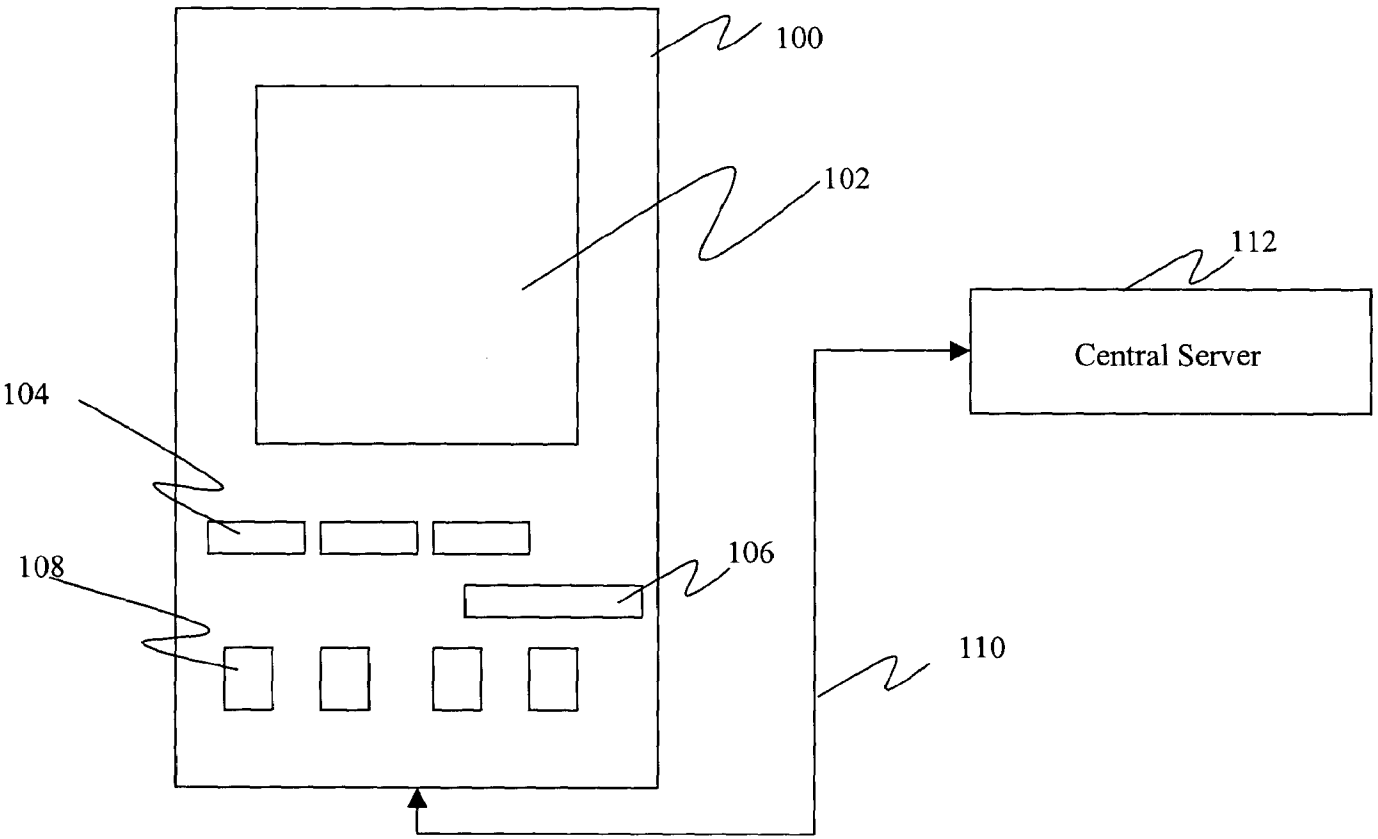
FIG. 1 is a block diagram of a player terminal in accordance with the present invention.

FIG. 1 illustrates a general player's terminal usable with the present invention. There will be an enclosure 100 having a video or other electronic display 102 viewable by a player. There will be one or more input ports or slots, shown generally as slots 104. These slots may be configured and equipped to receive bills, player ID cards, vouchers, low power RF or IR signals from a handheld device, smart cards, memory cards, and similar inputs. In all cases, the input will be used in accordance with its type to generate game play credits (i.e., in the case of bills, vouchers, or smart cards, directly; in the case of player IDs in the form of an EFT [electronic funds transfer] or ECT [electronic credit transfer] from a central server). There will typically be an output slot 106 for a printer to enable the printing and dispensing vouchers or tickets. Also shown are a plurality of player input buttons 108. The exact number and function of the player input buttons will be determined by the particular implementation of the player terminals requested by specific casinos or similar establishments. It is fully contemplated that some player terminals will make use of touch screens that could supplant the use of mechanical buttons altogether. A further implementation will use a tablet-style player terminal with a wireless connection to the central server. Any and all such variants are fully contemplated by the present invention.

Each player terminal must have an operable connection 110 to a central server 112. This will typically be a serial line or Ethernet connection within a single site, but readily includes any type of LAN/WAN configuration required for each particular installation, including physically remote sites, using a common server. Further contemplated are evolving networked connections such as wireless networks.

Each player terminal will have internal portions (not illustrated) that are typical for this type of gaming or entertainment machine. That includes electronic interfaces to each video or mechanical human interface device, electronic interfaces to a printer (if a printer is used), a network interface, at least one programmable logic unit (or CPU) and associated support chips including but not limited to static and dynamic memory, software executable on the CPU or main processor board to carry out gaming functions, and one or more interface boards and associated logic operably connecting each externally visible function or port to a CPU.

Figure 2:
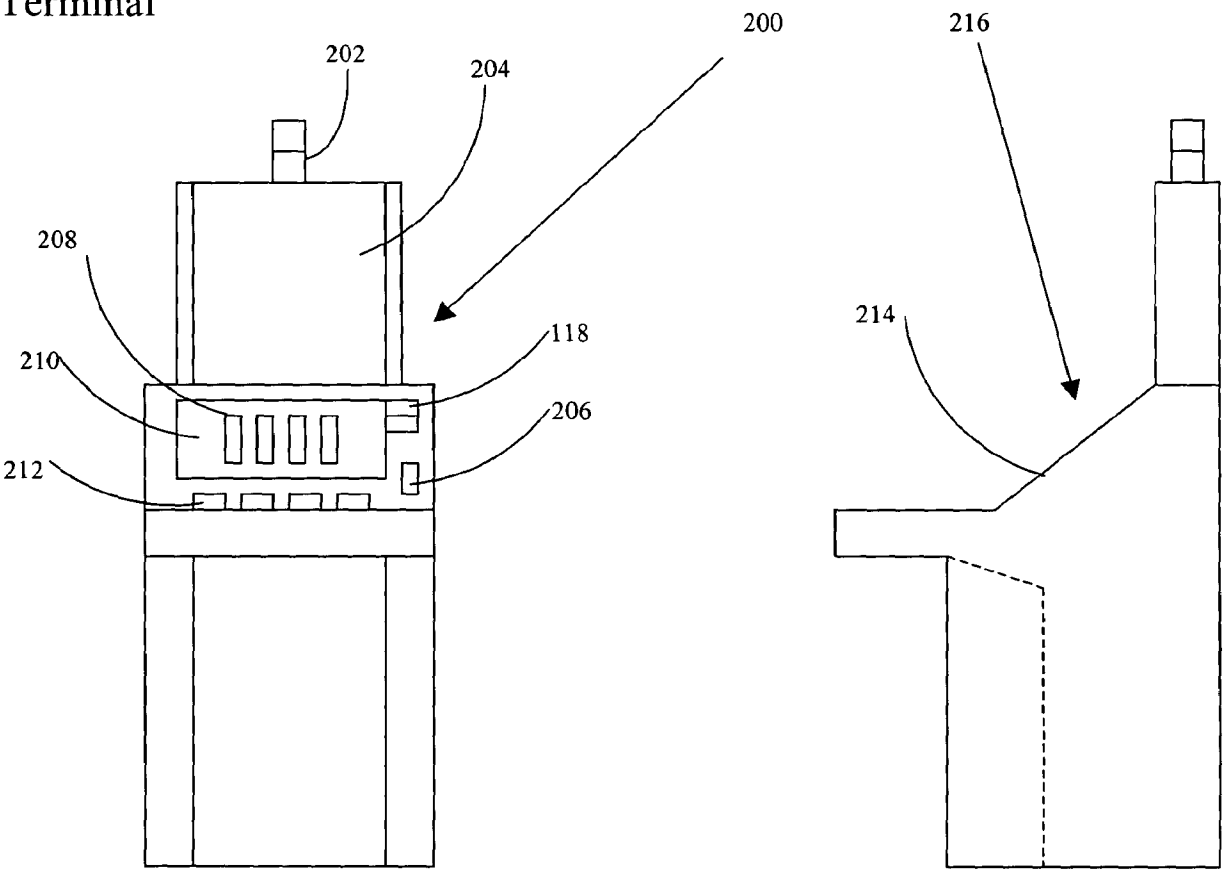
FIG. 2 is a block diagram illustrating a casino-style player terminal in accordance with the present invention.

FIG. 2 illustrates one preferred embodiment of the generic player terminal from FIG. 1. It is intended to mimic a traditional slant top casino gaming machine to enable players to feel like they are at a Nevada-style casino. Player terminals for use in a system according to the present invention are fully expected to be based on the same slant top game boxes as those used in traditional casinos. The programming executing on the main processor board will be different, as will some player interface buttons, but will be intended to provide real casino look and feel within the confines of a central determination system.

FIG. 2 illustrates a front view 200 and a side view 216. Candle 202 lights when there is a machine fault such as the machine running out of tokens or coins to pay a cash-out, a monetary prize over a certain amount to be awarded, etc. Area 204 is typically art for the game, and is usually passive. There is a monetary input slot 206, which is typically a bill acceptor. Monetary input slot 206 may be, or may include, a coin acceptor. Coin acceptors may be used in certain lower-denomination raffle game installations ("penny", "nickel", "quarter" betting). Area 210 will typically comprises a video screen having the appearance of a glass cover having opaque art, with windows 208 showing individual slots or reels. This would be used during an entertainment mode, where the player is shown what appears to be a Nevada-style game such as slots but where the game outcome is, in actuality, already known (having been sent by the central server). Prior to entering entertainment mode, area 210 will be used to display information about on-going central determination (lottery-style) games and betting options (ticket purchase options). There are a set of player input devices, typically buttons, shown at 114. Side view 116 shows the slanted portion of the machine (thus the general name "slant top"), which has the game viewing area 214. On some machines there will also be either one or two small numerical displays, shown as 118. One display shows the player the number of game credits they have, the other (if present) may show some kind of special raffle game announcement, or may simply have scrolling advertising for the casino. These displays may be found almost anywhere on a gaming machine that is visible to a player.

Figure 3:
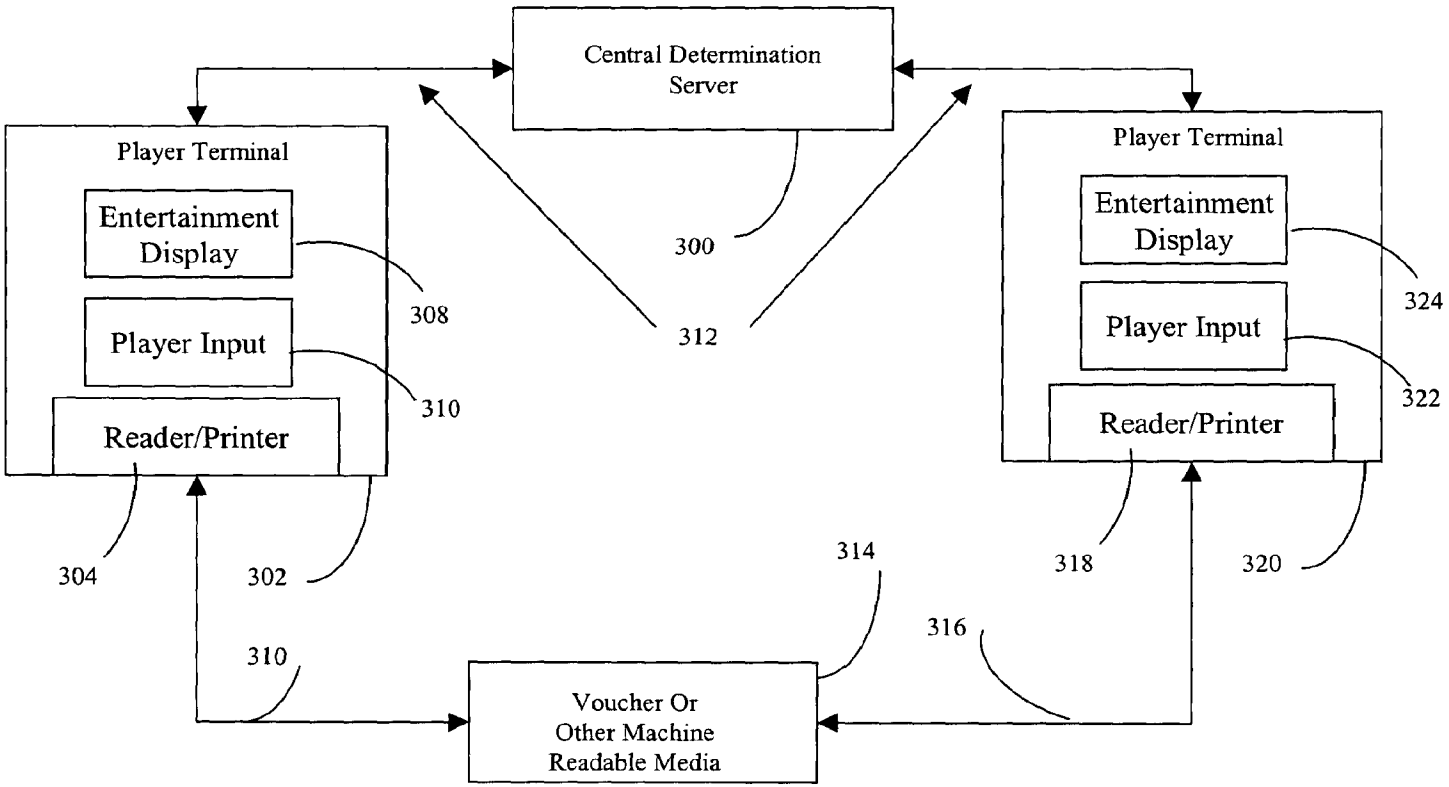
FIG. 3 is a functional block diagram of a central determination system in accordance with the present invention.

FIG. 3 illustrates a central determination system in accordance with the present invention. Player terminal or game device 302 and 320 have therein the typical components found in a gaming or entertainment machines, as described above for FIG. 1, and further including all embodiments such as wireless tablet-style gaming terminals. They will be controlled by programs suitable to implement the player terminal functions of the present invention. Two player terminals are shown for illustrative purposes; any number may be used. Further shown are reader/printers 304 and 318. Reader/printers 304 and 318 are configured to accept as input machine readable indicia (such as bar code on a voucher) or media (such as a magnetic strip on a card). Further, the reader/printers may also comprise IR or RF ports, or other interfaces to hand-held devices used by players. Reference to printers is further understood to be a compatible form with the readers in use with any particular installation. For example, if the reader is a voucher reader, then the printer is a voucher printer. If the reader is an RF port receiving signals from a hand-held device used by a player, then the "printer" (generically: output device) includes the concept of the transmission of RF signals in a manner receivable by the same hand-held device. Further included in player terminals 302 and 320 are player input devices 306 and 322.

Voucher 314 is one method a player may use to transfer game credits and/or game information (typically ticket purchase or winning ticket information) from one player terminal to another. This enables a player to stop playing at a terminal by requesting a voucher that has the player's current game play state thereon. This will typically be done using a unique ID (which may be comprised of the issuing machine ID coupled with date/time information to the granularity required for uniqueness, or other unique numerical ID) which will then be used to retrieve game information when the voucher is inserted into another player terminal. Alternatively, the voucher may have all outstanding ticket information on it, so that when a player inserts the voucher into another player terminal at a later time or date, the central server sends the results of the finished games corresponding to the tickets on the voucher to the player terminal now in use.

Also shown are network connections 312 which enable operable coupling of the player terminals to Central Determination Server 300. The present invention requires the use of at least one server 300, but is not limited to one. Each sever will have at least one pool of predetermined results, from which a single result is randomly drawn and sent to a player terminal when game play is initiated (conceptually the electronic equivalent of purchasing a scratch-off ticket at a lottery counter; the results are predetermined, but are not known to the player until the results are displayed). Depending on the specifics of each implementation, there may be a plurality of servers on a site or distributed over several sites. As discussed above, a player may request a voucher which (to a player) stops game play on that terminal. Either the player terminal generates a unique transaction ID or the central server may generate it (which device generates the unique transaction ID will be implementation dependent). In either case, the ticket data and unique transaction ID are stored in the database (Oracle or similar database package) on the server. The voucher mayor may not have all outstanding ticket data printed thereon—this will depend on the specifics of each implementation. The voucher will always have the unique transaction ID on it, preferably in encrypted form (this will require an encryption/decryption program on either each player terminal or on the server—the machines that generate unique IDs will need to have the capability to encrypt/decrypt). When a player inserts the voucher on a different player terminal, the server will (i) verify the tickets to be displayed on the player terminal if the ticket info was on the voucher, or (ii) retrieve any ticket info associated with the unique transaction ID on the voucher from its database.

The database on server 300 is also usable with player IDs, both in traditional form (a player ID card) and with APIDs (anonymous player IDs). The data about tickets bought, when, and on what machine will be kept in a manner associated with the player ID. The player ID will then be used to retrieve the information. This allows a player to keep one voucher or one player's card, and go from player terminal to player terminal as the wish, even with games in play.

Central determination or fixed pool games can be divided into games that use results from a single draw from a single pool, or use two (or more) draws from the same number of pools. These differences reflect the requirements of local jurisdictions. Some allow only single draws from a single poll per game play, while others allow single draws from more than one pool where the second or tertiary pools can then be used for certain additional play results. Different solutions to providing players with the appearance of bonus game play are found in different embodiments of the present invention, using single or multiple pool draws.

There is always a base game, which is the game shown to a player representing a predetermined win amount that is not a bonus, or secondary, game and which is always shown or played before a bonus or secondary game. The game terminal requests a game outcome (win amount or winnings, which include 0-value-win or losing game outcomes) from a server and receives a game outcome or game result. The game machine then has the job of creating a display that results in the paylines (or other winning indicia) which must show a total equal in value to the already determined win amount. This process is generally known as reverse mapping, which is taking a known result and creating the correct display of winning symbols. Reverse-mapping is the opposite of a normal Nevada-style gaming machine which takes the display of winning symbols and adds them up to determine a winning amount.

Figure 4:
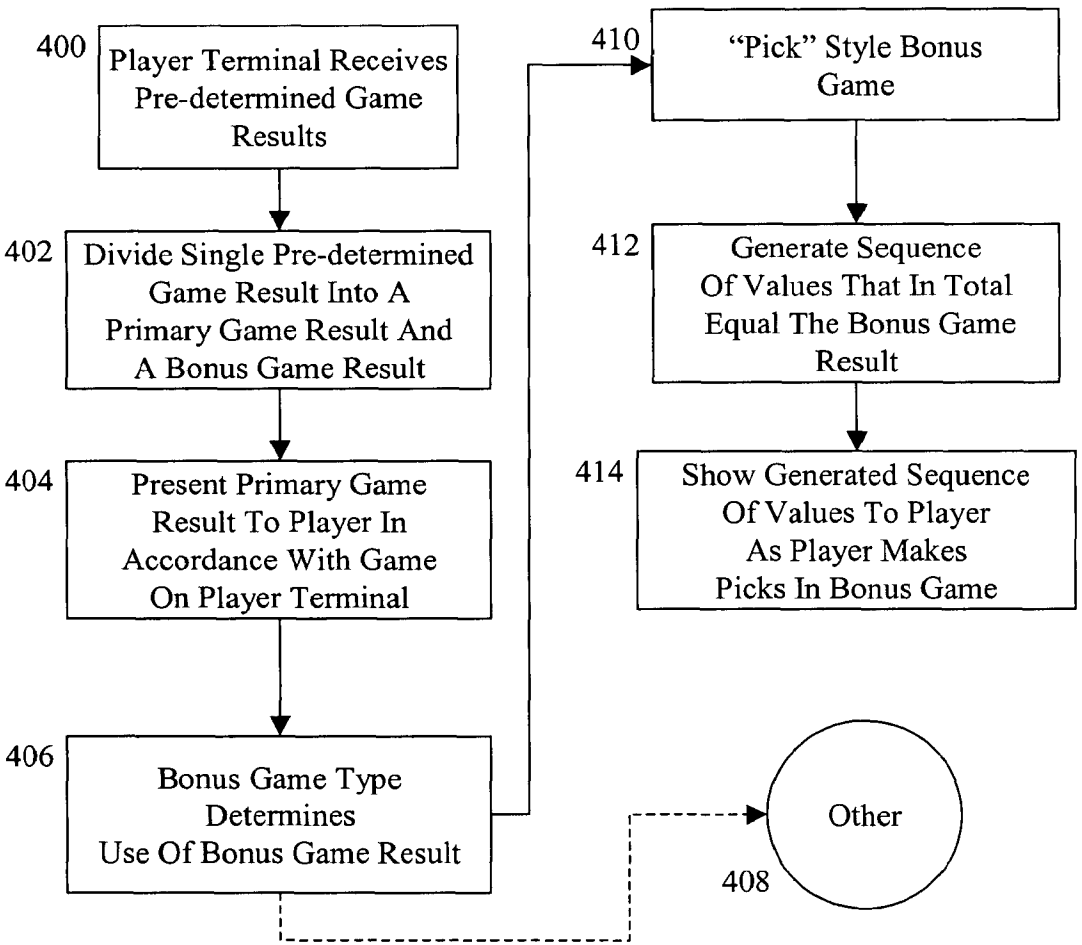
FIG. 4 is a flow diagram showing one embodiment of generating fixed-pool bonus games in accordance with the present invention.

A first method of using a single draw to create a base game result and a bonus is for the gaming machine is shown in FIG. 4. The actions corresponding to box 400 are all those needed such that a player terminal receives a game result from a central server (pool selection made upon a game play request and the results sent to the player terminal or game machine). Continuing into box 402, the predetermined result is divided into two portions which are to be used in reverse mapping "win" amounts shown to a player as the player plays the game (or views the game). The two portions include a first portion which will be "won" in the base game, that is, shown as won using reverse-mapping to display symbols or game indicia corresponding to the first amount. The second portion will be used to generate a bonus or secondary game, using the second portion of the predetermined win amount. Continuing on to box 404, the first portion is reverse-mapped into a display and is shown to the player; the display must show game indicia having the same value as the first portion.

Moving to box 406, the actions correspond to initiating a bonus or secondary game round. The second portion of the predetermined win amount will be used as the amount to be given to the player in the simulated bonus round game play. Different bonus game types require different ways of presenting the results to a player. If the bonus game type is a "pick" style bonus game, box 406 is left for box 410. If the bonus game play is not a "pick" style game, then circle 408 is entered for "Other" bonus game play types.

The actions corresponding to box 410 include initiating a pick style bonus round using the second portion of the predetermined result. A player picks (typically using a touch-screen) a one or more symbols from a plurality of symbols on the player terminal's display. In an actual Nevada-style game the results picked are randomized and summed after game play; in a central determination system the bonus round amount must be reverse-mapped into a bonus game or bonus screen display on the player terminal that mimics the appearance of a Nevada-style pick bonus game.

Continuing to box 412, a randomized value sequence is generated using a random number generator. The randomized sequence is constructed to generate a sequence of numbers that when added together, yield the bonus prize amount. This may be a sequence of one or more numbers and may include 0-value entries that are not "game over" entries (the game developers will decided if they want to make use of 0-value picks depending on the pick game being mimicked). The number in the sequence is variable to keep repeat players from detecting a pattern to the bonus games. Some pick style bonus games limit players to a single touch; in those cases, the full amount of the bonus game portion of the predetermined win will be shown to the player as soon as they indicate any of the pick indicia. When player may make a plurality of choices, then as each choice is made the corresponding element in the randomized sequence is displayed to the player (i.e., the first game indicia picked by the player results in the first element from the randomized sequence being displayed to the player, although it is possible to randomly associate elements from the list with player choices as well). The way in which the values will be shown to the player will be consistent with the bonus game being mimicked (i.e., the game indicia appears to "dissolve" on the screen showing a value, there is an award counter that increments to the side of the screen or buttons, etc.).

Play continues until the cumulative amount shown as won during the bonus game play corresponds to the second portion of the predetermined winnings, with the final choice a player makes typically being a "loser" pick. The exact form of a "loser" pick will be determined by the game, but involves the player making a choice from the remaining indicia and then being shown either a no-win screen or a "game over" screen (or game-over symbol), ending the bonus game. The later allows for the use of 0-values in the randomized sequence.

Pool Generation Or Protocol Use For Fixed-Pool Games With Bonus

An example Nevada-style game having bonus rounds could look like the following. Assume the base game has the following 3 prizes: 10; 100; 1000.

The game includes a bonus game, which may be entered or played after winning 1000 in the base game. The bonus game can have the following payouts: 10; 20; 30.

If the above game is being mimicked in a jurisdiction allowing fixed-pool games to use multiple pools, the base game outcome is drawn from a base game pool and when triggered, the bonus game outcome would be drawn from a bonus pool. The player terminal would receive these prizes as two parts: a base prize of 1000 credits, and a bonus prize of between 10-30 credits.

If the above game is being mimicked in a jurisdiction that requires fixed-pool games to use a single pool, the mimicked game's base game outcome and bonus game outcome would be combined into elements from the single pool, as follows: 10; 100; 1000; 1010//bonus; 1020//bonus; 1030//bonus.

When the player terminal receives a bonus ticket, it allocates the combined amount (greater than 1000) into a base game win amount (1000) and a bonus game win amount (the amount left after subtracting 1000).

Another example of a pick style bonus game paytable is as follows.

The paytable is laid out as follows:

| Pay Amount | # of Indicia Selected |
|---|---|
| COLLECT ('pooper' game indicia, which means show a no-win and collect accumulated winnings) | 1 |
| 250 | 2 |
| 150 | 3 |
| 100 | 4 |
| 75 | 5 |
| 60 | 6 |
| 50 | 7 |
| 45 | 8 |
| 30 | 9 |
| 25 | 10 |

The player has a 1 in 10 chance of hitting the game ending indicia. There are, however, many ways of presenting each combination of awards to the player.

In this example, there are 512 combinations in this screen. So for any given prize value, the RNG has to work through 512 combinations (worst case) to obtain a set of picks to match the bonus prize. Working through each combination to determine the outcome is called the brute force approach. Another method would be to store each possible bonus prize in the reverse map, along with some information on which series or sequence of picks will be used to generate that prize. The later is a more desirable implementation method when the amount of this information is reasonable.

In another game with a pick bonus screen the player can select up to 24 boxes. This generates 16 million possible outcomes, which is difficult to deal with from a brute force or data lookup scenario. Another problem is that there are not enough bonus triggers in the finite pool to cover all these bonus outcomes. The solution involves reducing the bonus game outcomes to a reasonable level that can still represent the game.

In this example, the base game triggers the bonus 180,000 times. A template can be created with the same number of tickets as the original game cycle, resulting in 180,000 different bonus prizes to map. There are existing gaming protocols having lower limits than 180,000, however, and part of the usefulness and novelty of the present invention is that it be able to work within limits of older (existing) protocols, which were not designed for use with extra play or bonus game machines. One existing protocol limits the number of unique tickets in a pool to approximately 50,000, so 180,000 must be reduced still further in order to fit these restrictions.

In the case of free spin games, this limits the number of free game outcomes that can be represented in the template. Free spin games are also significantly more difficult to reverse map.

One solution is to use a portion of a field in an existing protocol to send an index that can be used to do a table lookup into a set of bonus outcomes stored in a reverse map. That same index could be used to differentiate between similar amounts with different outcomes. Further, seed data can be sent in an existing field that can be used to map to and represent a set of bonus outcomes This is based on the idea that you use a RNG to generate the bonus prize originally. If the seed that was used to generate the bonus prize is saved and sent to the gaming machine, the same sequence can be regenerated using the saved seed. This requires some changes to the reverse mapping algorithm.

It is also possible to use the prize index and store all possible bonus prizes with seed value in a reverse map table.

Applies to a system where the Lottery terminal receives the entire prize on one electronic ticket only. For display purposes, the Lottery terminal may display this ticket outcome as a single prize, or a series of prizes providing entertainment to the player.

Methods involving limited prize information (i.e., a single draw and limited information passing between the central server and the player terminal). Typical in lottery situations, where the lottery terminal typically receives the prize value with an index value relating to the location in the prize pool from where the ticket was drawn.

One example follows.

Prize Pool Definition

| Prize Index | Prize Value | Prize Quantity |
|---|---|---|
| 0 | 0 | 10000 |
| 1 | 10 | 1000 |
| 2 | 20 | 2000 |
| 3 | 100 | 10 |
| 4 | 1000 | 10 |
| 5 | 1000 | 5 |
| 6 | 1100 | 2 |
| 7 | 1150 | 3 |
| 8 | 1200 | 1 |

Using the above example, the Terminal could receive the following information when a prize of 10 was drawn: Prize Index: 1; Prize Value: 10.

The terminal could use the information in several ways, including:

Verification:

The index and amount could also be stored on the terminal, and comparing this information to the received values can be used as a means of verifying that the terminal has the ability to display this outcome in a suitable fashion.

Display:

The index and value may also be used as a basis for some form of lookup on a table containing display data that may be used to display the outcome.

Display:

The index may be used to differentiate between different ways of displaying the same amount. In the Example above, the prize of 1000 could be displayed in different ways depending on the prize index received by the terminal.

Displaying a bonus prize: Following the example above, imagine a scenario where we wish to display the outcome in a series of stages to the player. We could make a determination that certain prizes can be broken up into two or more smaller prizes, which may then be displayed separately. As an example, assume the terminal received a prize of 1150, index 7 from the pool above. The terminal could make the determination that a suitable way to display this would be as follows:

Display a primary award of 1000 to the player

Display a secondary award of 150 to the player, involving some sort of bonus round.

Determining the bonus prize:

The bonus amount of any given prize may be calculated by first determining the primary award. This may be ascertained by using the prize index into a lookup table for display data. In the example above, assume that the prize of 1000 may be mapped to one or more primary outcomes by the terminal. Further, assume that the prize of 1150 is also mapped to a similar set of outcomes, which show a primary outcome of 1000 and also indicate a bonus round. The difference of 150 can then be applied to some form of algorithm or lookup table to determine a suitable outcome for the bonus round.

One such method would be to store possible bonus outcomes on the terminal, with display data.

| Bonus Prize Index | Bonus Amount | Bonus Display Data |
|---|---|---|
| 0 | 0 | XXXX |
| 1 | 100 | YYYY |
| 2 | 150 | ZZZZZ |
| 3 | 200 | AAAA |

A successful table lookup would verify that the bonus prize could be mapped. This method can be used for many different bonus outcomes.

More complicated bonus prizes:

One problem with bonus displays is that they can differ depending on the theme represented on the lottery terminal. This requires that the bonus outcomes are stored in many different ways, depending on the complexity of the bonus theme.

A bonus display data can take some of the following forms: an index to possible bonus display outcomes; a piece of data that can represent an outcome or set of outcomes i.e. a bitmap containing reel stop information used to display a slot type outcome; a piece of data relating directly to the bonus theme, i.e. the number of picks for a screen showing the player various outcomes, where the player must select some icon or other object to be awarded a prize; a piece of data that is used as a key to an algorithm to generate a set of suitable outcomes i.e. the data could be the seed used to regenerate a sequence of outcomes from a deterministic algorithm that was used to generate the bonus prizes in the first place.

Methods involving prize information with more variables—that is, a lottery or fixed pool system that has the ability to exchange more information than the prize index and value. This extra information may be used to supplement or replace the information stored on the terminal.

For example:

Prize Pool Definition

| Prize Index | Prize Value | Prize Quantity | Prize Information |
|---|---|---|---|
| 0 | 0 | 10000 | |
| 1 | 10 | 1000 | |
| 2 | 20 | 2000 | |
| 3 | 100 | 10 | |
| 4 | 1000 | 10 | |
| 5 | 1000 | 5 | XXXX |
| 6 | 1100 | 2 | YYYY |
| 7 | 1150 | 3 | ZZZZZ |
| 8 | 1200 | 1 | AAAA |

In the example above, the prize information field is used to store the bonus display information previously stored on the lottery terminal. This has the advantage of requiring fewer storage resources on the terminal side, but requires more communications overhead. Because the bonus display information is received at the same time as the prize, the terminal is not required to determine if the prize is a bonus or not: it already knows because extra information. This information is not limited to bonus displays only, it can also be used for primary display outcome information.

In a manner similar to the methods described above, this extra set of information could be used for the following methods of enhancing the display: an index to possible bonus display outcomes; a piece of data that can represent an outcome or set of outcomes i.e. a bitmap containing reel stop information used to display a slot type outcome; a piece of data relating directly to the bonus theme, such as the number of picks for a screen showing the player various outcomes, where the player must select some icon or other object to be awarded a prize; a piece of data that is used as a key to an algorithm to generate a set of suitable outcomes, i.e., the data could be the seed used to regenerate a sequence of outcomes from a deterministic algorithm that was used to generate the bonus prizes in the first place; the actual bonus amount, so the terminal does not have to do any calculations to determine the bonus amount; the number of bonus draws to make from secondary bonus pools (see below).

Working now with multiple pools (multiple draws fro different pools), if the jurisdiction allows it, there are further ways to generate bonus winnings. In this case, the wager amount is divided into two portions, with one portion being used with one pool (the main game winnings, if any) and a second portion used to get a result from a second pool (the bonus winnings, if any). This further enables the capability of a multi-draw games.

Prize Pool Definition—Primary

| Prize Index | Prize Value | Prize Quantity |
|---|---|---|
| 0 | 0 | 10000 |
| 1 | 10 | 1000 |
| 2 | 20 | 2000 |
| 3 | 100 | 10 |
| 4 | 1000 | 10 |

Prize Definition—Secondary

| | | |
|---|---|---|
| 0 | 0 | 5 |
| 1 | 100 | 2 |
| 2 | 150 | 3 |
| 3 | 200 | 1 |

In this example, the player would normally be awarded prizes from the first pool, but in special circumstances, the player would become eligible to draw prizes from the secondary pool, involving a bonus game.

Because the prize awarded from a lottery pool is picked randomly, the player can receive many more bonus outcomes than from the single draw method. For instance, if the prizes of 100 and 1000 in the primary pool allow the player to become eligible for a secondary prize, then the possible outcomes are as follows:

Bonus Combinations

| Prize Index | Prize Value |
|---|---|
| 0 | 0 |
| 1 | 10 |
| 2 | 20 |
| 3 | 100 |
| 4 | 100 (100 + 0) |
| 4 | 200 (100 + 100) |
| 4 | 250 (100 + 150) |
| 4 | 400 (100 + 300) |
| 5 | 1000 |
| 5 | 1000 (1000 + 0) |
| 5 | 1100 (1000 + 100) |
| 5 | 1150 (1000 + 150) |
| 5 | 1200 (1000 + 200) |

This method is advantageous because each possible prize combination is not required to be stored in the prize pool initially. Furthermore, it is easier to separate primary and bonus outcomes and display them because they are separate draws. Note that the secondary draw is not in any way visible obvious to the player, as they perceive the entire set of outcomes as a single event; it constitutes a single game play: some portion of the primary pool wager must be applied towards the secondary or bonus pool(s).

Methods for generating, storing and displaying outcomes on fixed pool or lottery terminals include storing reel stops for slot emulation. In a typical slot machine, the reel strips and paytable define how the game pays. A set of reel stops are indexes into the reel strips, and when the symbols at these stops are evaluated against the paytable, the appropriate win amount may be determined.

In order to represent such a game on a lottery or finite pool system, it is first necessary to generate all possible reel stop combinations and associated wins to create the finite pool. Furthermore, some method must be used to recreate these stops in order to display any given win amount in an appropriate fashion.

One such method is to store a set of valid reel stops for a given win as a series of bitmaps as follows:

Give a slot machine with 3 reels as follows:

| Stop | Reel_1 | Reel_2 | Reel_3 |
|---|---|---|---|
| 0 | ACE | KING | QUEEN |
| 1 | KING | ACE | KING |

-continued

| Stop | Reel_1 | Reel_2 | Reel_3 |
|---|---|---|---|
| 2 | QUEEN | ACE | ACE |
| 3 | KING | QUEEN | ACE |
| 4 | KING | KING | QUEEN |
| 5 | ACE | QUEEN | KING |

Assuming 3 Aces pay a prize amount, we would need to store the following combinations:

| | | |
|---|---|---|
| 0 | 1 | 2 |
| 0 | 2 | 2 |
| 0 | 2 | 3 |
| 5 | 1 | 2 |
| 5 | 2 | 2 |
| 5 | 2 | 3 |

One such storage method is to store valid reel stops for any given reel as a bit mask, where an on bit represents a valid reel stop, and an off bit represents an invalid stop. In the example above, the table could be represented as 3 such bit masks for each reel as follows:

Reel 1: 00100001 Reel 2: 00000110 Reel 3: 00001100

This method can be extended to storing masks for multiple wins, further saving storage space.

The following algorithm may be used to regenerate the reel stops from such a bit mask. First, the number of valid stops (bit on) is counted. Then a random valid stop is chosen and the outcome is calculated and verified against the prize received from the lottery system.

General method for storing key data. This method is more general than the method described above, usable for many different types of outcomes. This method is based upon the idea of generating a number of outcomes to be stored in a lottery (fixed) pool, and regenerating those outcomes to provide a display on the terminal side.

Assuming a set of outcomes can be generated by some algorithm, and that algorithm is deterministic and can be driven by some small amount of key data, then it is possible to store the. key and use it to regenerate any given set of outcomes on demand.

As an example, consider a bonus display where the player is given the choice of picking a number of boxes. There are a total of 30 boxes, arranged randomly on a 6×5 grid. 24 of the boxes contain prizes, while 6 of the boxes contain a 'pooper' prize. The game is such that the player picks until they hit a pooper prize, and are awarded the value of their accumulated picks.

For example:

| | | | |
|---|---|---|---|
| Pooper | | Pooper | |
| | Pooper | | |
| | | Pooper | Pooper |

The empty grids above contain prizes. This game has 2^24 possible outcome combinations, or 16 million. In theory, any attempt to determine the boxes picked for a given prize would involve testing all these combinations. If it is possible to generate the prizes using an algorithm, then it is possible to store a small amount of data for each outcome and use this to regenerate the picks, rather than attempting to brute force the solution. It has been found that one usable algorithm uses a RNG called the LCG (Linear Congruential Generator), with the following formula:

$$Random=69069*Random+23606797.$$

If the first instance of Random is stored, then repeated calls to this function will generate a sequence of random numbers that can be used to pick the prizes in the table above. This seed or key value is stored, along with the bonus prize on the lottery terminal. The bonus prize is also stored in the lottery pool as described above.

If the terminal receives such a bonus prize, the seed value is looked up and the same algorithm is used again to determine the appropriate outcome to be displayed to the player. This method avoids a brute force solution, which may be computationally expensive.

Although the description above contains many specificities, these should not be construed as limiting the scope of the invention but rather as providing an illustration of the presently preferred embodiment of the invention.

What is claimed is:

1. A gaming terminal comprising:

a player terminal in operable communication with a central server, configured to send game play requests to the central server and receive game play results from the central server, the game play results determined by the central server from fixed-pools of elements derived from a non-fixed-pool slot machine game, each element corresponding to a single game play result determined prior to base and bonus game play;

the player terminal further configured to:

determine a base game play result and a bonus game play result from a single game play result received from the central server, reverse-map the base game play result into a display such that the display simulates the non-fixed-pool slot machine game by showing game indicia having an award value corresponding to the base game play result, and further showing a bonus game display, different from the base game play display, having a value corresponding to the bonus game play result, wherein the single game play result is a fixed sum that is awarded to the player.

2. The gaming terminal of claim 1, wherein the game play result further includes an indicator recognizable by the gaming terminal, the indicator indicating that the game play result comprises a base game play result and a bonus game play result.

3. The gaming terminal of claim 2, wherein an award associated with the bonus game result is calculated by subtracting a known base game award from a total award associated with the game play result.

4. A method of providing game play at a gaming terminal, the method comprising the steps of:

receiving a wager on a game at the player terminal;

generating a game result request at the player terminal;

receiving a game result selected from a fixed pool of game results derived from a non-fixed-pool slot machine game, at the player terminal, wherein the game play result represents a fixed sum award determined prior to base and bonus game play;

determining a base game result and a bonus game amount from the selected game result; and simulating the non-fixed pool slot machine game by:

playing the game and awarding the base game result;

starting a bonus game;

enabling play of the bonus game; and awarding the bonus game amount.

5. The method of claim 4, wherein the bonus game comprises a plurality of indicia.

6. The method of claim 4, further comprising: dividing the bonus game play amount into a set of partial win results that, in total, are an amount equal to a bonus award associated with the bonus game result; selecting bonus game indicia; awarding one of the partial win results; and repeating the selecting and awarding until all of the partial win amounts are awarded.

7. The method of claim 4, further comprising: recognizing, in the game result, an indicator indicating that the game result comprises a base game result and a bonus game result.

8. The method of claim 4, further comprising: calculating an award associated with the bonus game result by subtracting an award associated with the base game result from a total award associated with the game result.

* * * * *